US005896001A

United States Patent [19]

Shishido

[11] Patent Number: 5,896,001

[45] Date of Patent: Apr. 20, 1999

[54] BLACK MATRIX COLOR CATHODE-RAY TUBE HAVING A RED PATTERN WIDER THAN EACH OF GREEN AND BLUE PATTERNS

[75] Inventor: Akira Shishido, Shiga, Japan

[73] Assignee: NEC Corporation, Tokyo, Japan

[21] Appl. No.: 08/886,061

[22] Filed: Jun. 30, 1997

[30] Foreign Application Priority Data

Jun. 28, 1996 [JP] Japan ..... 8-168801

[51] Int. Cl.[6] ..... H01J 29/18

[52] U.S. Cl. ..... 313/461; 313/466; 313/473

[58] Field of Search ..... 313/422, 461, 313/465, 466, 470, 473

[56] References Cited

U.S. PATENT DOCUMENTS 3,706,845 12/1972 Heyman et al. ..... 313/465
5,565,742 10/1996 Shichao et al. ..... 313/422
5,682,079 10/1997 Kang ..... 313/461

FOREIGN PATENT DOCUMENTS 63-164143 7/1988 Japan ..... H01J 29/32

*Primary Examiner*—Sandra O'Shea
*Assistant Examiner*—Michael Day
*Attorney, Agent, or Firm*—Sughrue, Mion, Zinn, Macpeak & Seas, PLLC

[57] ABSTRACT

A black matrix color cathode-ray tube includes red, green, and blue luminescent patterns, wherein each of the red luminescent patterns has a wider area than each of the green and the blue luminescent patterns. The red, the green, and the blue luminescent patterns may be either of stripe or of dot shape. Preferably, the green and the blue luminescent patterns have a common area. More preferably, each green luminescent pattern has a wider area than each blue luminescent pattern. The cathode-ray tube displays one of red, green, and blue colors even when ones of the red, the green, and the blue luminescent patterns are selectively excited concurrently with others of the red, the green, and the blue luminescent patterns undesirably excited.

11 Claims, 2 Drawing Sheets

BLACK MATRIX COLOR CATHODE-RAY TUBE HAVING A RED PATTERN WIDER THAN EACH OF GREEN AND BLUE PATTERNS

BACKGROUND OF THE INVENTION

This invention relates to a black matrix color cathode-ray tube and, more particularly, to a high-definition black matrix color display vacuum tube.

In the manner which is known in the art and will later be described in greater detail, a black matrix color cathode-ray tube comprises a face panel enclosing a vacuum space, red or magenta, green, and blue or cyan luminescent patterns, namely, luminescent patterns of three additive primaries, on the face panel inside the vacuum space, and an electron gun in the vacuum space opposite to the face panel. The electron gun directs an exciting electron beam selectively onto the red, the green, and the blue luminescent patterns to make the red, the green, and the blue luminescent patterns emit red, green, and blue rays through the face panel. During manufacture, a black or light absorbing film of, for example, graphite is formed on an inside surface of the face panel and its adjacency and a photoresist film is formed on the black film. Using a shadow mask, an optical beam is directed onto the photoresist film to eventually form openings where the red, the green, and the blue luminescent patterns are subsequently deposited. In this manner, a black matrix film is formed. It is possible to use a photosensitive luminescent material on subsequently manufacturing each set of the red, the green, and the blue luminescent patterns.

In Japanese Patent Prepublication (A) No. 164,143 of 1988, an improved black matrix color cathode-ray tube is disclosed. It is inevitable during an opening forming process (which takes from 90 to 120 seconds for providing the openings for the red, the green, and the blue pattern sets) that the photoresist film has a gradually reduced temperature, such as from 42° C. to 35° C. in an ambient temperature of 25° C . It will be assumed that the optical beam is incident onto the photoresist film with an exposure spot given an area kept constant and that first through third sets of openings are successively formed for one and other of the red, the green, and the blue pattern sets.

When PAA (polyacrylamide) is used as a photoresist material, each opening of the first set has the smallest area with each opening of the second set and of the third set given successively wider areas. When PVA (poly(vinyl alcohol)) or ADC (ammonium dichromate) is used as the photoresist material, each opening of the first set has the widest area with each opening of the second and the third sets given successively smaller areas. On the other hand, it is said in the Japanese patent prepublication that a uniformity in a display of achromatic or hue-less white color is achieved when the red luminescent pattern is smaller in area than the blue luminescent pattern and moreover when the blue luminescent pattern is smaller in area than the green luminescent pattern.

However, it should be taken into account that the exciting electron beam may not necessarily hit at only one of the red, the green, and the blue luminescent patterns that is intended. Instead, the electron beam may concurrently hit at a part of an adjacent luminescent pattern. This phenomenon frequently occurs resulting in an undesirable additive color mixture particularly when the color cathode-ray tube is a high-definition one or when the cathode-ray tube is a wide aperture one having a short tube length as used for a color display device in terminal equipment.

It will later be quantitatively described that the undesirable additive color mixture of each of basic or pure green and blue colors to a basic red color deteriorates saturation or chroma of the basic red color. In addition, it should be noted as will later be exemplified that such a color mixture between the basic red and green colors results in an appreciable amount of change in chromaticity of the color to give rise to a consequent reduction of tolerance in the saturation of the color as a result of luminous efficacy of the human eye. Although improvement of the uniformity in the achromatic white color is feasible by a change in the process of fluorescent pattern deposition, it is impossible to cope with the deterioration in the saturation of a basic color.

SUMMARY OF THE INVENTION

It is consequently an object of the present invention to provide a black matrix color cathode-ray tube capable of displaying three additive primary colors with suppression of deterioration in saturation of each of the primary colors that should be displayed.

It is another object of this invention to provide a black matrix color cathode-ray tube which is of the type described and can achieve a gentle tolerance in the saturation of each primary color even when another of the primary colors is concurrently displayed.

It is a still another object of this invention to provide a black matrix color cathode-ray tube which is of the type described and in which the saturation of a basic red color is insured even when either of a basic blue and a basic green color is simultaneously undesiredly excited.

It is yet another object of this invention to provide a black matrix color cathode-ray tube which is of the type described and in which there is little change in chromaticity of the basic red color even when the basic green color is simultaneously undesiredly excited.

It is a further object of this invention to provide a black matrix color cathode-ray tube which is of the type described and which can keep uniformity of an achromatic white color display even when one and another of the primary colors are concurrently displayed in an unbalanced manner.

It is a still further object of this invention to provide a high definition black matrix color cathode-ray tube which is of the type described.

It is a yet further object of this invention to provide a wide aperture black matrix color cathode-ray tube which is of the type described.

Other objects of this invention will become clear as the description proceeds.

In accordance with this invention, there is provided a black matrix color cathode-ray tube comprising a face panel, red, green, and blue luminescent patterns on the face panel, and an electron gun for directing an electron beam selectively onto the red, the green, and the blue luminescent patterns to make the red, the green, and the blue luminescent patterns emit rays of red, green, and blue colors, wherein the red, the green, and the blue luminescent patterns have areas which suppress deterioration in saturation of the red, the green, and the blue colors.

DESCRIPTION OF THE PREFERRED EMBODIMENTS

Figure 1:
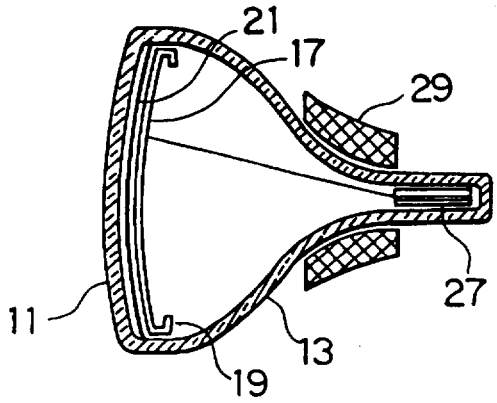
FIG. 1 PRIOR ART
FIG. 1 schematically shows an axial sectional view of a black matrix color cathode-ray tube.

Referring to FIG. 1, a black matrix color cathode-ray tube will generally be described. The cathode-ray tube comprises a face panel 11 and a tube body 13 having an end attached to the face panel 11 and an opposite end which is open during manufacture and subsequently sealed to enclose a vacuum space and covered with a socket (not shown).

During manufacture of the cathode-ray tube, a black or light absorbing film is formed on an inside surface of the face panel 11 and its adjacency of the tube body 13 as by depositing or otherwise coating graphite onto the inside surface and its adjacency. A photoresist film is formed on the black film to cover its part on the inside surface. The photoresist film may be made of PVP (polyvinylpyrrolidone) besides any one of PAA, PVA, and ADC as exemplified above. The PVP is similar in photosensitive characteristics to PAA. The photoresist film is exposed to an optical beam in time sequential succession to eventually leave a black matrix film 15 (later depicted). On exposing the photoresist film to the optical beam, a shadow mask 17 is used. The shadow mask 17 is attached to a mask frame 19, which is held, in turn, by the tube body 13. In the manner which will become clear as the description proceeds, the black matrix film 15 has openings therethrough with areas which are intentionally controlled either by controlling an order of exposure or by controlling an amount of the exposure.

Figure 2:
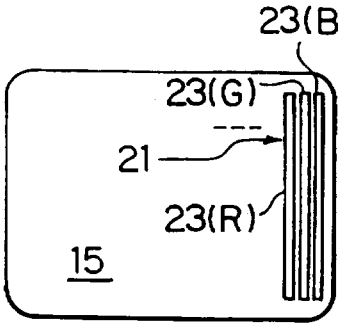
FIG. 2 PRIOR ART
FIG. 2 schematically shows a rear view of luminescent stripe patterns of the cathode-ray tube illustrated in FIG. 1.

Turning to FIG. 2, while keeping FIG. 1 in mind, a luminescent or fluorescent film 21 is formed in the openings of the black matrix film 15. Here, the openings are slits. The luminescent film 21 comprises red or magenta, green, and blue or cyan luminescent stripe patterns 23(R), 23(G), and 23(B). Such patterns will either individually or collectively be designated by a reference numeral 23 with suffixes (R), (G), and (B) omitted.

Figure 3:
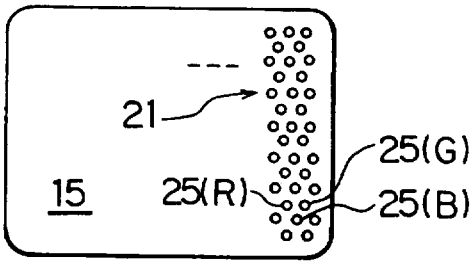
FIG. 3 PRIOR ART
FIG. 3 schematically shows a rear view of luminescent dot patterns of the cathode-ray tube illustrated in FIG. 1.

Further turning to FIG. 3 keeping FIG. 1 in mind, the openings are dot-shaped here. The luminescent film 21 comprises red, green, and blue luminescent dot patterns 25(R), 25(G), and 25(B) or 25. In FIGS. 2 and 3, it is possible on manufacturing the luminescent film 21 to use a photosensitive luminescent material as described heretobefore for each of red, green, and blue colors and to use lithographic patterning. At any rate, the luminescent stripe or dot patterns 23 or 25 may be wider in area than the openings of the black matrix film 15.

Turning back to FIG. 1, an electron gun 27 is supported at a neck portion of the tube body 13. After evacuated, the opposite end is sealed. A yoke 29 is placed to surround the tube body 13. When the electron gun 27 is energized with the yoke 29 controlled, an exciting electron beam passes through a pertinent one of perforations of the shadow mask 17 and is focussed on one of the stripe or dot patterns 23 or 25 as depicted by a solid line. This one of the stripe or dot patterns 23 or 25 emits rays of a relevant one of three additive primaries, namely, basic or pure red, green, and blue colors, through the face panel 11.

Figure 4:
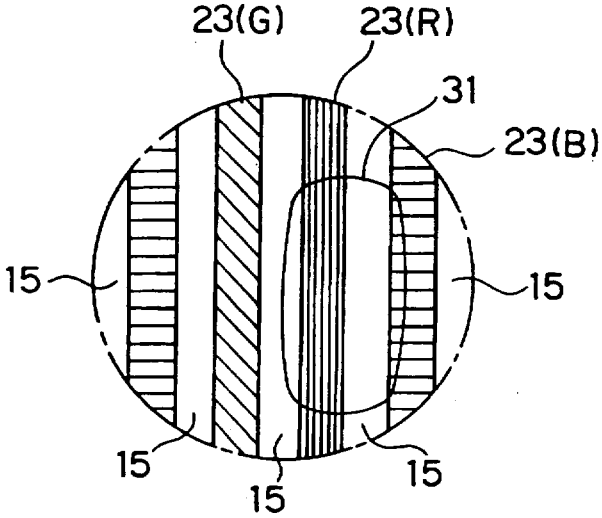
FIG. 4 PRIOR ART
FIG. 4 is an enlarged partial front view of conventional luminescent stripe patterns and of an electron beam spot on a part of one of the luminescent stripe patterns.

Referring afresh to FIG. 4 and to FIGS. 1 and 2, the red, the green, and the blue stripe patterns 23(R), 23(G), and 23(B) have a substantially common stripe width and therefore a substantially common pattern area in a conventional black matrix color cathode-ray tube. It should be noted throughout the specification that the stripe width or the pattern area is not a width or an area of each luminescent stripe pattern but is a width or an area of each opening of the black matrix film 15, namely, a width or an area which each of the red, the green, and the blue stripe patterns 23 has when viewed through the face panel 11. The focussed electron beam hits the luminescent film 21 as an electron beam spot 31. In the example being illustrated, the beam spot 31 is used to make the cathode-ray tube show a red picture cell at the illustrated portion of an image. The beam spot, however, covers a part of an adjacent luminescent stripe pattern, such as a part of the blue luminescent stripe pattern 23(B).

It is now clear, in the manner pointed out hereinabove, that the exciting electron beam may not hit at only one of the red, the green, and the blue luminescent stripe patterns 23, that is the red luminescent stripe pattern 23(R) in FIG. 4, but that the electron beam may concurrently hit at a part of the adjacent luminescent stripe pattern. This phenomenon will be named spurious hit and frequently occurs to result in an undesirable additive (namely, not subtractive) color mixture particularly either when the cathode-ray tube is a high-definition one or when the cathode-ray tube is a wide aperture one that has a short tube length between the face panel 11 and the opposite end as, for example, for use in a color display in terminal equipment.

Besides a uniformity or homogenuity of an achromatic or hue-less white color display, the spurious hit deteriorates saturation or chroma of either the basic red color (FIG. 4) or another of the primary colors. Such a deterioration was quantitatively measured to give results which will be described in the following.

Continuously referring to FIGS. 1, 2, and 4, it may be mentioned here that the red, the green, and the blue stripe patterns 23 are formed in red, green, and blue sets which are spatially cyclically repeated on the inside surface of the face panel 11. It will now be assumed that the electron beam is directed selectively onto the red stripe patterns 23(R). In the meantime, the electron beam may partially hit at the green or the blue stripe patterns 23(G) or 23(B). The cathode-ray tube displays a basic red display, on which a small amount of a green or a blue display is superposed as a result of the spurious hit to deteriorate the saturation. Table 1 shows basic colors along a left column by R, G, and B.

TABLE 1

| | | |
|---|---|---|
| R | B | 0.07 |
| | G | 0.08 |
| G | B | 0.02 |
| | R | 0.01 |
| B | R | 0.02 |
| | G | 0.05 |

It will now be presumed that others of the primary colors are superposed to 10% on each of the basic colors of the left columns as indicated by B and G and the like along a middle column. In each instance, the deterioration has a degree on a U-V chromaticity diagram as described along a right column. It is now understood that deterioration is most conspicuous when the basic color is red as a result of chromatic efficacy of the human eye.

Moreover, the spurious hit gives rise to a change or variation of a basic color when one or another of other basic primary colors is undesiredly simultaneously excited. In other words, the spurious hit adversely affects a tolerance in each of the basic primary colors. Again as a result of the chrominance efficacy, the change is most conspicuous when the basic color is red as shown in Table 2 by a chromaticity of each set of fluorescent patterns on an x-y chromaticity coordinate system.

TABLE 2

| color | x | y |
|---|---|---|
| G | 0.290 | 0.605 |
| B | 0.150 | 0.065 |
| R | 0.628 | 0.335 |

Figure 5:
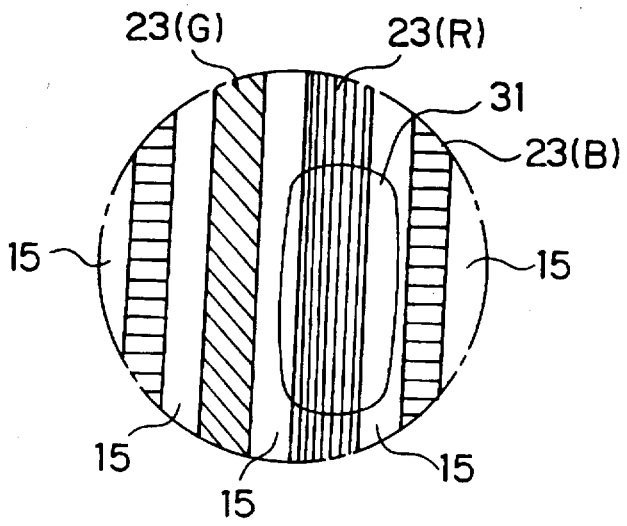
FIG. 5 is an enlarged partial front view of luminescent stripe patterns of a black matrix color cathode-ray tube according to a first embodiment of the instant invention and of an electron beam spot on a part of one of the luminescent stripe patterns.

Referring now to FIG. 5 in addition to FIGS. 1 and 2, the description will proceed to a black matrix color cathode-ray tube according to a first preferred embodiment of the present invention. The luminescent film 21 comprises as above the red, the green, and the blue stripe patterns 23(R), 23(G), and 23(B). These stripe patterns of the three additive primary colors have, however, different width or areas.

More particularly, the red luminescent pattern, such as 23(R), has a widest area. The blue luminescent pattern, as 23(B), has a narrowest area. The green luminescent pattern, as 23(G), has a medium area. It should be noted in connection with each luminescent stripe pattern that such an area refers to throughout this specification an area per unit length of the luminescent stripe pattern.

It may furthermore be noted here that each luminescent stripe pattern has a left and a right margin contiguous, when seen through the face panel 11, to neighboring parts of the black matrix film 15. The red luminescent stripe pattern 23(R) has the area such that the beam spot 31 does not hit an adjacent luminescent stripe pattern, here the blue luminescent stripe pattern 23(B). When the electron beam is selectively directed to the red luminescent stripe pattern 23(R) to place the beam spot 31 in substantially tangential to the left margin of the red luminescent stripe pattern 23(R), the beam spot 31 does not come in contact with the blue stripe pattern 23(B).

In FIG. 5, the spurious hit scarcely occurs on the green luminescent stripe pattern or patterns 23(G) when it is intended to make the luminescent film 21 display a red image. The blue luminescent stripe pattern or patterns 23(B) are less frequently hit than the green luminescent ones 23(G). In Table 1 given in the foregoing, it is clear that this area choice is very desirable.

It may be possible in connection with FIG. 5 to make the luminescent patterns, such as 23, have narrower areas than conventional ones and to widen light-absorbing stripes of the black matrix 15. This would, however, results in a decreased brightness of each picture or image. The brightness is determined approximately by an arithmetic sum of the luminescent patterns, as 23, on which the electron beam is selectively focussed. The cathode-ray tube being illustrated is therefore capable of attaining a substantially identical brightness as a conventional one. It is additionally possible to maintain the uniformity in the white color display because an area ratio is kept constant everywhere in a raster.

Again in connection with FIG. 5, it may be mentioned here in a color display device of terminal equipment that the achromatic white color display usually has a color temperature between 6500° K and 9300° K and an x and a y axis value of the x-y chromatic coordinate system between 0.313 and 0.281 and between 0.329 and 0.311, respectively. This white color display is obtained by making the electron beam hit at the blue, the green, and the red luminescent patterns, such as 23(B), 23(G), and 23(R), with an electric current for the electron gun 27 (FIG. 1) given in current percent between 23 and 29, 32 and 36, and 45 and 35, respectively.

In the manner described in the foregoing, the current percent successively grows larger from the blue luminescent pattern towards the red luminescent pattern through the green luminescent pattern in order optimally to get the white color display. In the conventional black matrix color cathode-ray tube, such a successively varying current percentage must be achieved either by actually varying the electric current for the electron gun 27 or varying focussing at the beam spot 31. In contrast, it is possible in the cathode-ray tube being illustrated to attain a desired current percent without troublesome control of the electric current or of the focussing of the electron beam and with a readily achieved balance in electron beam intensity at the beam spot 31. This is advantageous in raising resolution of picture cells. Incidentally, it is readily understood that the area can be optimally selected for the luminescent patterns, such as 23, of the three primary colors either by selecting the order of exposure to an optical beam or the intensity of the optical beam on forming the black matrix film 15.

Figure 6:
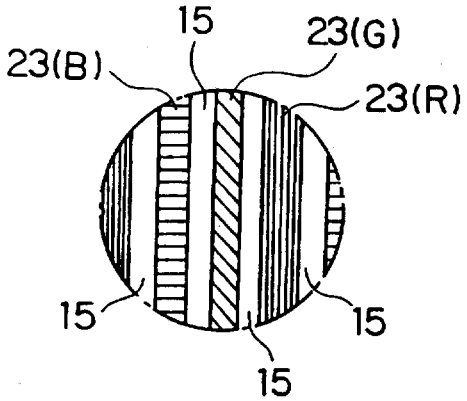
FIG. 6 is an enlarged partial front view of luminescent stripe patterns of a black matrix color cathode-ray tube according to a second embodiment of this invention.

Turning to FIG. 6 keeping FIGS. 1 and 2 in mind, attention will be directed to a black matrix color cathode-ray tube according to a second preferred embodiment of this invention. In the example being illustrated, the red luminescent stripe pattern 23(R) has a greater area. Each of the green and the blue luminescent stripe patterns 23(G) and 23(B) has a smaller area which is common to the green and the blue luminescent patterns 23.

Figure 7:
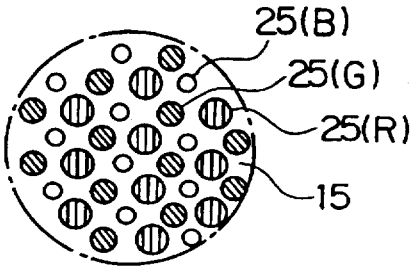
FIG. 7 is an enlarged partial front view of luminescent dot patterns of a black matrix color cathode-ray tube according to a third embodiment of this invention.

Referring now to FIG. 7 keeping FIGS. 1 and 3 in mind, the description will proceed to a black matrix color cathode-ray tube according to a third preferred embodiment of this invention. Here, the red luminescent dot pattern 25(R) has a largest or greatest diameter and consequently a widest area. The blue luminescent dot pattern 25(B) has a shortest diameter and therefore a narrowest area. The green luminescent dot pattern 25(G) has a medium diameter or area.

Figure 8:
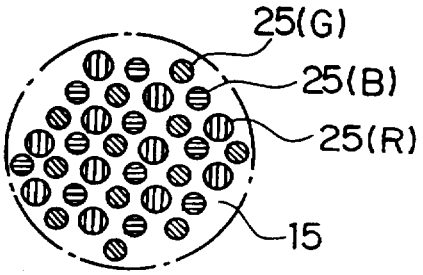
FIG. 8 is an enlarged partial front view of luminescent dot patterns of a black matrix color cathode-ray tube according to a fourth embodiment of this invention.

Turning to FIG. 8 keeping FIGS. 1 and 3 in mind, attention will be directed to a black matrix color cathode-ray tube according to a fourth preferred embodiment of this invention. Here again, the red luminescent dot pattern 25(R) has a larger diameter, and accordingly a wider area. Each of the green and the blue luminescent dot patterns 25(G) and 25(B) has a common shorter diameter or a common narrower area.

In each of FIGS. 7 and 8, it is preferred that when the beam spot 31 (FIG. 5) is a circle with its center offset from a center of the red luminescent dot pattern 25(R) to inscribe the red luminescent dot pattern 25(R) under consideration, the circle should outscribe adjacent ones of the green and the blue luminescent dot patterns 25(G) and 25(B). Area ratios of the red, the green, and the blue luminescent dot patterns are preferably within ranges described before in connection with the electric currents used to obtain the achromatic white color display.

While this invention has thus far been described in specific conjunction with only a few preferred embodiments thereof, it will now be readily possible for one skilled in the art to carry this invention into effect in various other manners. For example in FIGS. 5 and 6, it is possible to arrange the luminescent stripe patterns 23 in curvilinearly parallel. In FIGS. 7 and 8, it is possible to use an approximately elliptic dot patterns, similar to the beam spot 31 in outline, rather than circular dot patterns.

What is claimed is:

1. A black matrix color cathode-ray tube comprising a face panel, red, green, and blue luminescent patterns on said face panel, and an electron gun for directing an electron beam selectively onto said red, said green, and said blue luminescent patterns to make said red, said green, and said blue luminescent patterns emit rays of red, green, and blue colors, wherein said red luminescent pattern has an area larger than that of said blue luminescent pattern and larger than that of said green luminescent pattern so as to suppress deterioration in saturation of each of said red, said green, and said blue colors.

2. A black matrix color cathode-ray tube as claimed in claim 1, wherein the areas of said red, said green, and said blue luminescent patterns are defined by areas of openings of a black matrix film formed on an inside surface of said face panel and filled with luminescent materials of said red, said green, and said blue luminescent patterns.

3. A black matrix color cathode-ray tube as claimed in claim 2, wherein said red, said green, and said blue luminescent patterns are dot patterns.

4. A black matrix color cathode-ray tube as claimed in claim 3, wherein the areas of said red, said green, and said blue luminescent patterns each with respect to the total luminescent area are in the range of between 45% and 35%, between 32% and 36%, and between 23% and 29%, respectively.

5. A black matrix color cathode-ray tube as claimed in claim 4, wherein said red luminescent pattern is inscribed by a beam spot of the electron beam focused on said red, said green, and said blue luminescent patterns wherein said red, said green, and said blue luminescent patterns are configured such that said beam spot does not also simultaneously inscribe the green and the blue luminescent patterns which are adjacent to the first-mentioned red luminescent pattern.

6. A black matrix color cathode-ray tube as claimed in claim 2, wherein the areas of said red, said green, and said blue luminescent patterns are selected to keep uniformity of an achromatic white color display when excited with said electron gun energized by current, as a percentage of total current, in the ranges of between 45% and 35% for said red luminescent patterns, between 32% and 36% for said green luminescent patterns, and between 23% and 29% for said blue luminescent patterns.

7. A black matrix color cathode-ray tube as claimed in claim 1, wherein said blue and said green luminescent patterns have an area of the same size.

8. A black matrix color cathode-ray tube comprising a face panel, red, green, and blue luminescent patterns on said face panel, and an electron gun for directing an electron beam selectively onto said red, said green, and said blue luminescent patterns to make said red, said green, and said blue luminescent patterns emit rays of red, green, and blue colors, wherein said red, said green, and said blue luminescent patterns have areas which suppress deterioration in saturation of each of said red, said green, and said blue colors, wherein the areas of said red, said green, and said blue luminescent patterns are defined by areas of openings of a black matrix film formed on an inside surface of said face panel and filled with luminescent materials of said red, said green, and said blue luminescent patterns, wherein said red luminescent pattern has a widest area, said blue luminescent pattern has a narrowest area, and said green luminescent pattern has a medium area.

9. A black matrix color cathode-ray tube as claimed in claim 8, wherein the areas of said red, said green, and said blue luminescent patterns each with respect to the total luminescent area are in the range of between 45% and 35%, between 32% and 36%, and between 23% and 29%, respectively.

10. A black matrix color cathode-ray tube as claimed in claim 8, wherein said red, said green, and said blue luminescent patterns are stripe patterns.

11. A black matrix color cathode-ray tube as claimed in claim 10, each of said red, said green, and said blue luminescent patterns having first and second edges contiguous to a body of said black matrix directed in a predetermined direction as well as third and fourth edges in an opposite direction, wherein the first edge of said red luminescent pattern is outwardly tangential to a beam spot of the electron beam focussed on said red, said green, and said blue luminescent patterns when the first edge of either of said green and said blue luminescent patterns is substantially outwardly of said beam spot even if the last-mentioned green and blue luminescent patterns are adjacent to the second edge of the first-mentioned red luminescent pattern in said predetermined direction.

* * * * *